US006880180B2

(12) United States Patent
Hayashi et al.

(10) Patent No.: US 6,880,180 B2
(45) Date of Patent: Apr. 19, 2005

(54) SANITARY WASHING TOILET SEAT DEVICE

(75) Inventors: Koichi Hayashi, Nishikamo-gun (JP); Yuji Sugiyama, Kariya (JP); Takashi Muto, Kariya (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/401,719

(22) Filed: Mar. 31, 2003

(65) Prior Publication Data

US 2003/0213056 A1 Nov. 20, 2003

(30) Foreign Application Priority Data

Apr. 12, 2002 (JP) ..... 2002-109964

(51) Int. Cl.[7] ..... E03D 1/00
(52) U.S. Cl. ..... 4/313; 4/DIG. 3; 4/443
(58) Field of Search ..... 4/313, DIG. 3, 4/443, 444, 447, 448, 420.2–420.4

(56) References Cited

U.S. PATENT DOCUMENTS

2003/0019023 A1 * 1/2003 Furukawa et al. ..... 4/420.4

FOREIGN PATENT DOCUMENTS

| | | | |
|---|---|---|---|
| JP | 2001-95728 A | * | 4/2001 |
| JP | 2001-095722 | * | 4/2001 |
| JP | 2001-299644 A | * | 10/2001 |
| JP | 2002-339430 A | * | 11/2002 |

* cited by examiner

*Primary Examiner*—Khoa D. Huynh
(74) *Attorney, Agent, or Firm*—Oblon, Spivak, McClelland, Maier & Neustadt, P.C.

(57) ABSTRACT

A sanitary washing toilet device which includes a toilet seat, a toilet seat cover, and a case fixed to a rear top periphery portion of a toilet bowl. The case rotatably connected with the toilet seat and the toilet seat cover. The sanitary washing toilet device further includes an optical sensor device provided on a front surface of the case for detecting an open and closed state of at least the toilet seat cover.

11 Claims, 5 Drawing Sheets

SANITARY WASHING TOILET SEAT DEVICE

This application is based on and claims priority under 35 U.S.C. § 119 with respect to Japanese Patent Application No. 2002-109964 filed on Apr. 12, 2002, the entire content of which is incorporated herein by reference.

FIELD OF THE INVENTION

The present invention relates to a sanitary washing toilet seat device. More particularly, the present invention pertains to a sanitary washing toilet seat device for washing an anus and the private parts of a user.

BACKGROUND OF THE INVENTION

With known sanitary washing toilet seat device for washing an anus and the private parts, the anus washing and the private parts washing are performed by either one of an anus washing switch or a bidet switch provided on an operation portion.

The device for anus washing and the private parts washing of the known sanitary washing toilet seat device have the following specifications so that a restroom will not wet with splashed water by a jet of the washing water by operating the anus washing switch or the bidet switch under a condition that a user is not sitting on a toilet seat.

First, when both a toilet seat cover and the toilet seat are under a detected position (i.e., closed state), neither the anus washing nor the private parts washing is performed even if the anus washing switch or the bidet switch is operated.

Second, when the toilet seat cover is under a non-detected position (i.e., open state) and the toilet seat is under the detected position (i.e., closed state), neither the anus washing nor the private part washing is performed even if the anus washing switch or the bidet switch are operated unless the user is sitting on the toilet seat.

Third, when both the toilet seat cover and the toilet seat are at the non-detected position (i.e., open state), neither the anus washing nor the private parts washing is performed even if either the anus washing switch or the bidet switch is operated.

In addition, more detailed electric energy saving mode is determined by recognizing the open and closed states of the toilet seat and the toilet seat cover concerning the energy conservation.

In order to satisfy the aforementioned specifications, at least a position sensor for detecting a position of the toilet seat cover and a seating sensor for sensing the existence of the user sitting on the toilet seat are required. Because the position sensor is provided on the known sanitary washing toilet seat device as a factor of a damper for detecting a rotation of a rotation shaft (i.e., a pin) rotatably connecting the toilet seat cover and the toilet seat to a case, the construction of the damper is complicated.

A need thus exists for a sanitary washing toilet seat device which detects the condition of a toilet seat cover with a simple construction.

SUMMARY OF THE INVENTION

In light of the foregoing, the present invention provides a sanitary washing toilet device which includes a toilet seat, a toilet seat cover, and a case fixed to a rear top periphery portion of a toilet bowl. The case rotatably is connected with the toilet seat and the toilet seat cover. The sanitary washing toilet device further includes an optical sensor means provided on a front surface of the case for detecting an open and closed state of at least the toilet seat cover.

BRIEF DESCRIPTION OF THE DRAWING FIGURES

The foregoing and additional features and characteristics of the present invention will become more apparent from the following detailed description considered with reference to the accompanying drawing figures in which like reference numerals designate like elements.

DETAILED DESCRIPTION OF THE INVENTION

Figure 1:
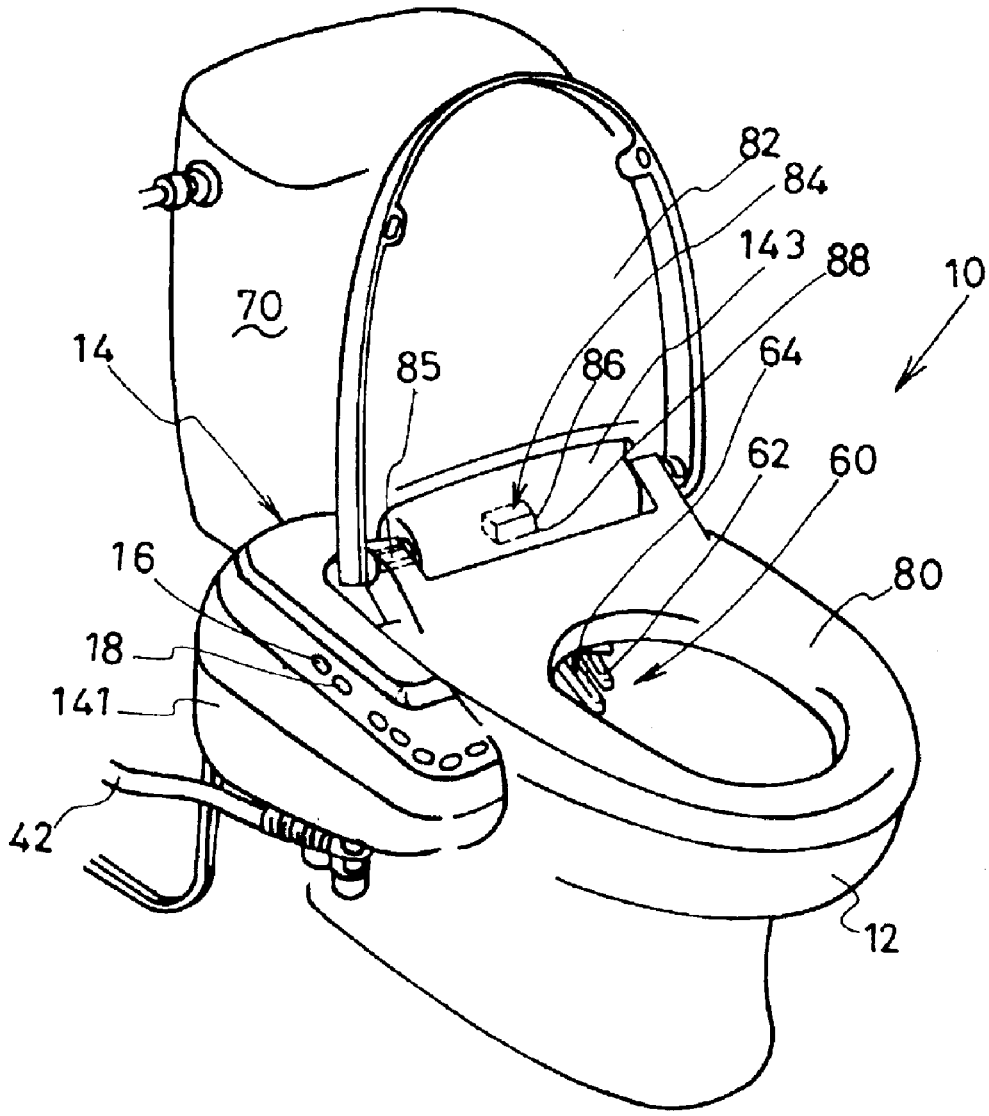
FIG. 1 is a perspective view of a sanitary washing toilet seat device according to an embodiment of the present invention.
Figure 2:
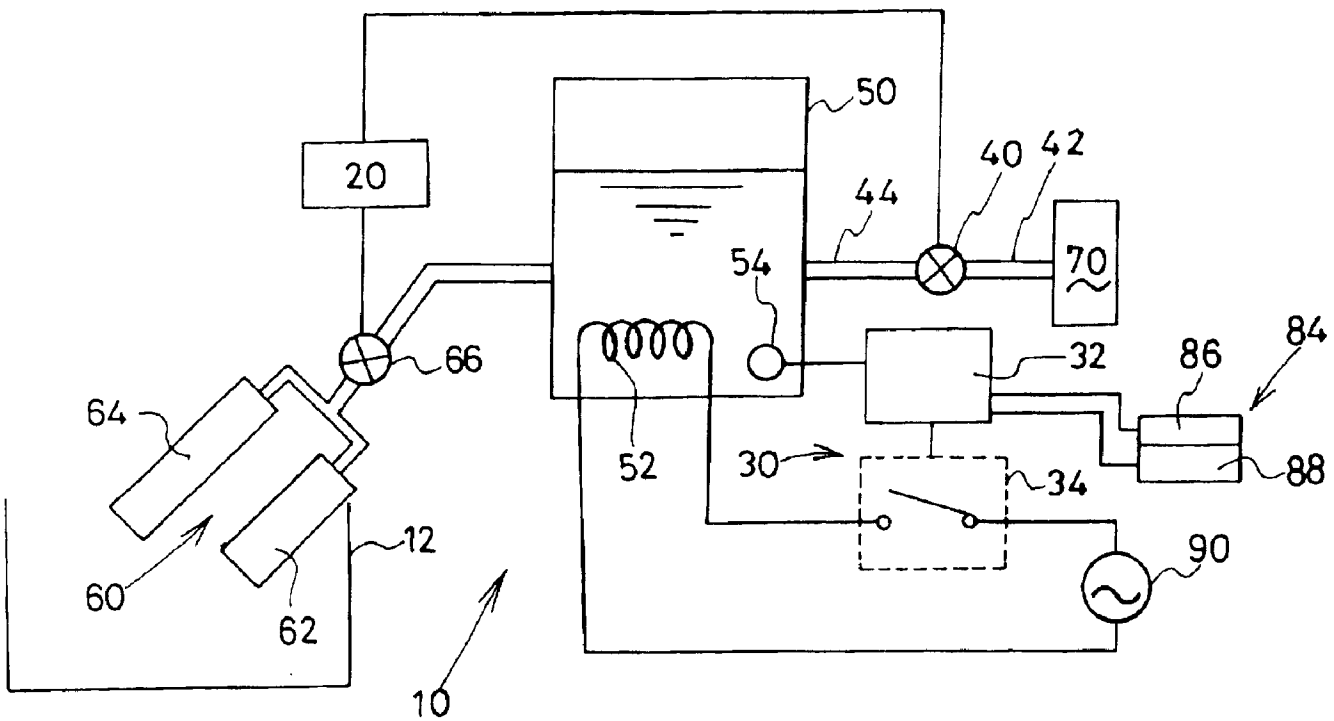
FIG. 2 is a block view of a control system of the sanitary washing toilet seat device of FIG. 1.

One embodiment of a sanitary washing toilet seat device according to the present invention will be explained with reference to the illustrations of FIGS. 1–6 as follows.

A sanitary washing toilet seat device 10 includes a case 14 fixed to a rear top surface of a toilet bowl 12. The case 14 is provided with a first control mechanism 20, a second control mechanism 30, a solenoid valve 40, a warm water tank 50 for reserving therein an amount of warm water heated by a heater 52, and a nozzle mechanism 60.

The solenoid valve 40 provided in a sleeve portion 141 on one side in the case 14 is connected to a water pressure supply source 70 via a hose 42, and the warm water tank 50 via a hose 44. When an anus washing switch 16 (bidet switch 18) provided on the sleeve portion 141 of the case 14 is operated, the solenoid valve 40 is opened by the first control mechanism 20, the warm water in the warm water tank 50 is pushed out by the water pressure from the water source 70 to be supplied to a nozzle mechanism 62 for washing anus (a nozzle mechanism 64 for the bidet) via a switching valve 66. Then, the nozzle mechanism 62 for washing anus (the nozzle mechanism 64 for the bidet) is extended in the toilet seat 12 and the warm water is jet from the nozzle mechanism 62 for washing the anus (the nozzle mechanism 64 for the bidet) to wash the user's private part. The operational position of the switching valve 66 determines which nozzles the warm water is supplied to.

The warm water tank 50 is positioned in the sleeve portion 141 in the case 14. The water in the warm water tank 50 is heated by the heater 52. The water temperature is always detected by a temperature sensor 54 and the detected temperature is transmitted to a CPU 32 of the second control mechanism 30 as a signal. When the water temperature reaches a predetermined value, the CPU 32 controls the energization from a power source 90 to the heater 52 by intermittently connecting a triac 34 for always maintaining the predetermined water temperature.

Figure 3:
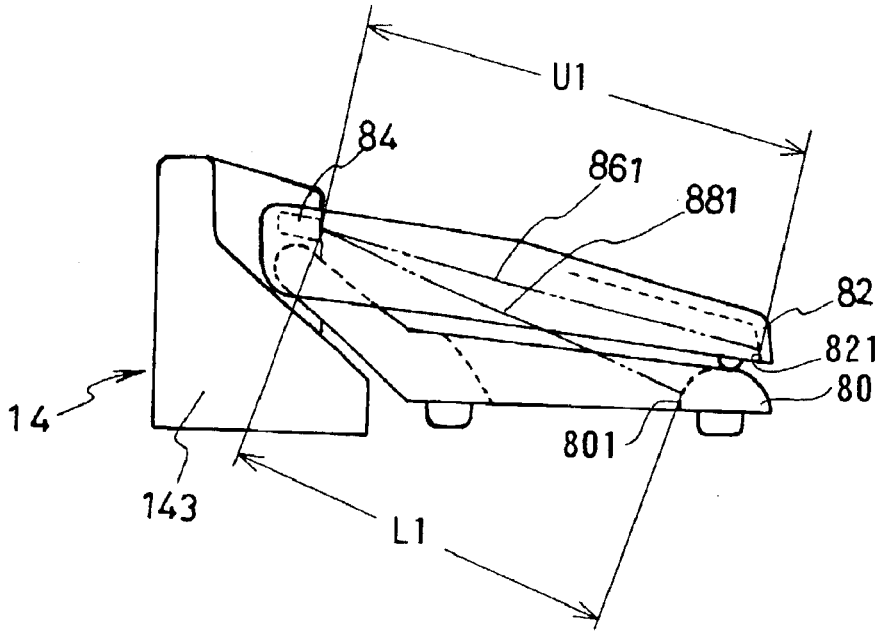
FIG. 3 is an explanatory view of the sanitary washing toilet seat device showing a toilet seat cover and a toilet seat being at a closed position.

As shown in FIG. 1, the case 14 includes a central expansion portion 143 to which each rear end portions of a toilet seat 80 and a toilet lid or toilet seat cover 82 are rotatably connected via a common pin 85. Thus, the toilet seat 80 and the toilet seat cover 82 achieve the following postures:

First, a state that the toilet seat 80 and the toilet seat cover 82 are at the closed position (shown in FIG. 3). Second, a state that the toilet seat 80 is at the closed position and the toilet seat cover 82 is at the open position (shown in FIG. 4). And third, a state that the toilet seat 80 and the toilet seat cover 82 are at the open position (shown in FIG. 6).

A sensor portion 84 is provided on a center of a front surface of the central expansion portion 143. The sensor potion 84 includes a first distance sensor 86 and a second distance sensor 88 (i.e., which are serving as an optical sensor means). Under a state shown in FIG. 3, a distance U1 (L1) between a first distance sensor 86 (second distance sensor 88) and an internal periphery front portion 821 of the toilet seat cover 82 under the closed position (an internal periphery front portion 801 of the toilet seat at the closed position) is determined as a reference distance using a triangulation by sighting and emitting a laser beam 861 (a laser beam 881) to the internal periphery front portion 821 of the toilet seat cover 82 at the closed position (the internal periphery front portion 801 of the toilet seat 80 at the closed position) from the first distance sensor 86 (the second distance sensor 88). The reference distance U1 determined by the first distance sensor 86 (the reference distance L1 determined by the second distance sensor 88) is memorized in a memory portion (not shown) of the control device (CPU) 32.

Figure 4:
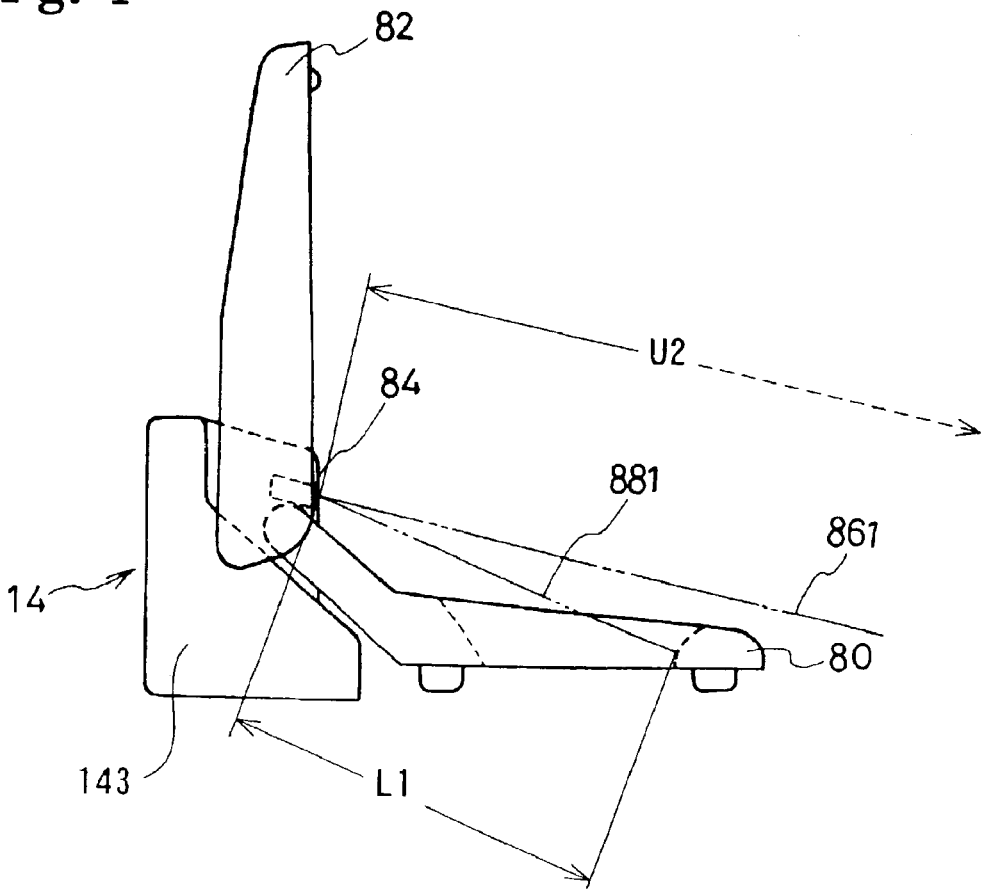
FIG. 4 is an explanatory view of the sanitary washing toilet seat device showing the toilet seat cover being at an open position and the toilet seat being at the closed position.
Figure 5:
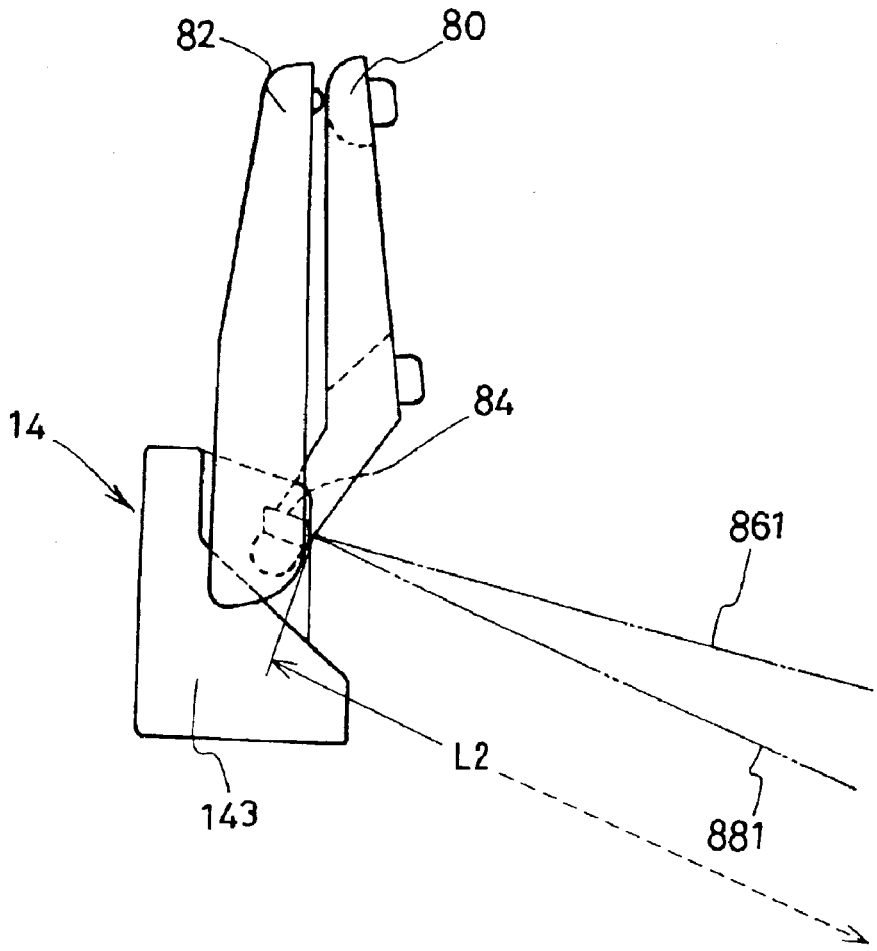
FIG. 5 is an explanatory view showing the toilet seat cover and the toilet seat being at the open position.

As shown in FIG. 4, when the toilet seat cover 82 is raised to be displaced to the open position from the state shown in FIG. 3, a measured distance U2 measured by the first distance sensor 86 becomes larger than the reference distance U1 because there is no object which reflects the laser beam 861 irradiated from the first distance sensor 86. As shown in FIG. 5, when the toilet seat 80 is raised to be displaced to the open position from the state shown in FIG. 4, a measured distance L2 measured by the second distance sensor 88 becomes larger than the reference distance L1 because there is no object to reflect the laser beam 881 irradiated from the second distance sensor 88. Thus, in case the distance measured by the first distance sensor 86 (second distance sensor 88) is longer than the reference distance U1 (L1), it is judged that the toilet seat cover 82 (toilet seat 80) is at the open position.

Figure 6:
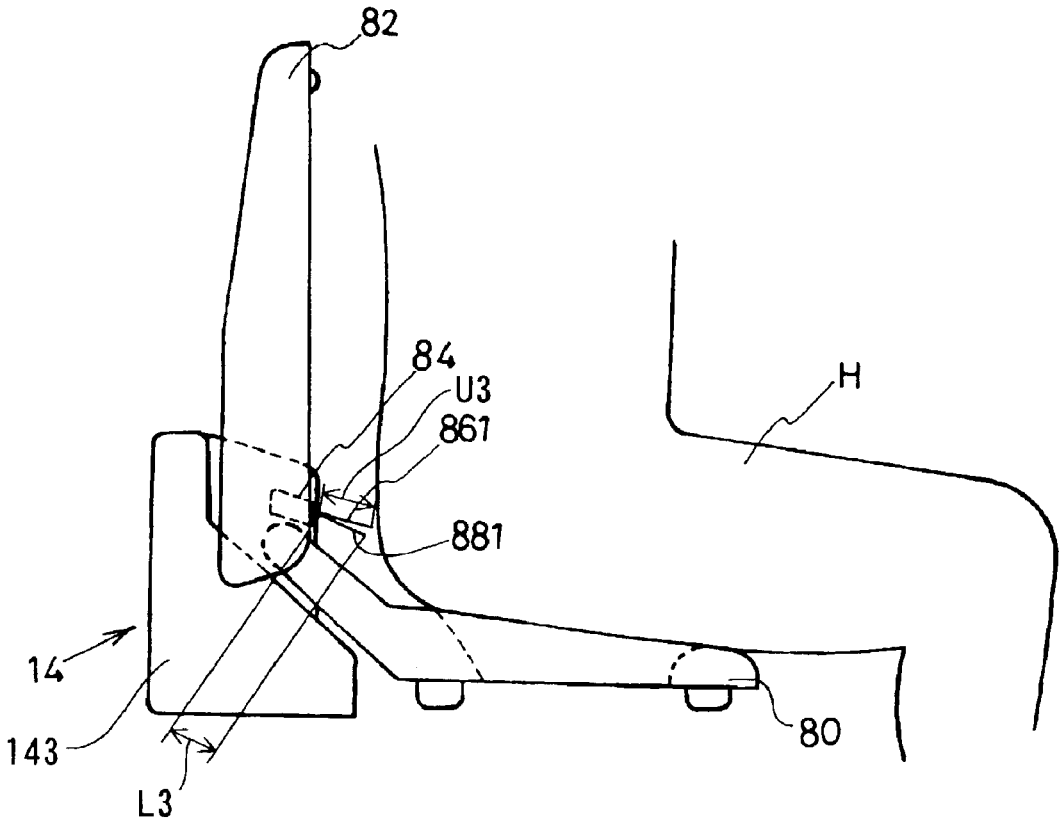
FIG. 6 is an explanatory view of the sanitary washing toilet seat device showing the toilet seat cover being at the open position, the toilet seat being at the closed position, and a user being sitting on the toilet seat.

On the other hand, as shown in FIG. 6, in case a user H is sitting on the toilet seat 80 in the state shown in FIG. 4, a measured distance U3 (L3) measured by the first distance sensor 86 (the second distance sensor 88) becomes shorter than the reference distance U1 (L1) because the laser beam 861 irradiated from the first distance sensor 86 and the laser beam 881 irradiated from the second distance sensor 88 is reflected at the hips of the user H. Accordingly, it is judged that the user H is sitting on the toilet seat 80 at the closed position when the distance measured by the first distance sensor 86 and the distance measured by the second distance sensor 88 are shorter than the reference distance U1 and the reference distance L1 respectively.

As foregoing, with the sanitary washing toilet seat device of the present invention, whether the toilet seat cover and the toilet seat are at either the closed position or the open position and whether the user is sitting on the toilet seat can be judged based on an actually measured distance measured by the first distance sensor 86 for measuring the distance between the first distance sensor and the internal periphery front portion of the toilet seat cover 82 at the closed position as the reference distance and the measured distance measured by the second distance sensor 88 for measuring the distance between the second distance sensor and the internal periphery front portion of the toilet seat 80 at the closed position as the reference distance. Thus, the construction linked to the damper is not required for detecting the toilet seat cover and thus, the construction of the damper can be simplified.

According to the embodiment of the present invention, the position of the toilet seat cover is detected without detecting the rotation of the rotation shaft (i.e., pin) rotatably connecting the toilet seat cover to the case by providing the optical sensor means for detecting the open and closed state of at least the toilet seat cover. Thus, because the detection of the position of the toilet seat cover is performed without using damper, the construction of the damper mechanism is not complicated.

According to the embodiment of the present invention, it is judged that the toilet seat cover is open when the distance measured by the first distance sensor is longer than the reference distance, it is judged that the toilet seat is open when the distance measured by the second distance sensor is longer than the reference distance, it is judged that the toilet seat cover is open and the toilet seat is closed when the distance measured by the first distance sensor is longer than the reference distance and the distance measured by the second distance sensor is equal to the reference distance, and it is judged that the toilet seat cover is open and the user is sitting on the toilet seat at the closed position when the distance measured by the first distance sensor is shorter than the reference distance and the distance measured by the second distance sensor is shorter than the distance measured by the second distance. Accordingly, the potion of the toilet seat cover can be detected without detecting the rotation of the rotations shaft (i.e., pin) rotatably connecting the toilet seat cover and the toilet seat to the case, in roster words, the position of the toilet core can be detected without damper. Accordingly, the complicated construction of the damper is not required.

The principles, preferred embodiment and mode of operation of the present invention have been described in the foregoing specification. However, the invention which is intended to be protected is not to be construed as limited to the particular embodiment disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A sanitary washing toilet device comprising:

a toilet seat;

a toilet seat cover;

a case fixed to a rear top periphery portion of a toilet bowl, the case being rotatably connected with the toilet seat and the toilet seat cover; and an optical sensor means provided on a front surface of the case wherein the optical sensor means includes:

(i) a first distance sensor which detects the existence of an use sitting on the toilet seat and wherein said first distance sensor also detects, and the open and closed state of the toilet seat cover when the user is not sitting on said toilet seat; and (ii) a second distance sensor which detects the open and closed state of the toilet seat.

2. A sanitary washing toilet device according to claim 1, wherein the toilet seat cover is judged as being in the open state when a distance measured by the optical sensor means is greater than a reference distance.

3. A sanitary washing toilet seat device according to claim 1, wherein the toilet seat cover is judged as being in the open state when a distance measured by the first distance sensor is greater than a reference distance.

4. A sanitary washing toilet seat device according to claim 1, wherein the toilet seat is judged as being in the open state when a distance measured by the second distance sensor is greater than a reference distance.

5. A sanitary washing toilet seat device according to claim 1, wherein the toilet seat cover is judged as being in the open state and the toilet seat is judged as being in the closed state when a distance measured by the first distance sensor is greater than a first reference distance and a distance measured by the second distance sensor is equal to a second reference distance.

6. A sanitary washing toilet seat device according to claim 1, wherein the toilet seat cover is judged as being in the open state and a user is sitting on the toilet seat when a distance measured by the first distance sensor is less than a first reference distance and a distance measured by the second distance sensor is less than a second reference distance.

7. A sanitary washing toilet seat device according to claim 2, wherein the reference distance is determined to be a distance between the optical sensor means and a front internal peripheral portion of the toilet seat cover in the closed state.

8. A sanitary washing toilet seat device according to claim 3, wherein the reference distance is determined to be a distance between the first distance sensor and a front internal peripheral portion of the toilet seat cover in the closed state.

9. A sanitary washing toilet seat device according to claim 4, wherein the reference distance is determined to be a distance between the second distance sensor and a front internal peripheral portion of the toilet seat in the closed state.

10. A sanitary washing toilet seat device according to claim 5, wherein the first reference distance is determined to be a distance between the first distance sensor and a front internal peripheral portion of the toilet seat cover in the closed state and the second reference distance is determined to be a distance between the second distance sensor and a front internal peripheral portion of the toilet seat in the closed state.

11. A sanitary washing toilet seat device according to claim 6, wherein the first reference distance is determined to be a distance between the first distance sensor and a front internal peripheral portion of the toilet seat cover in the closed state and the second reference distance is determined to be a distance between the second distance sensor and a front internal peripheral portion of the toilet seat in the closed state.

* * * * *